US005893016A

United States Patent [19]

Landa et al.

[11] Patent Number: 5,893,016

[45] Date of Patent: Apr. 6, 1999

[54] APPARATUS FOR PRINTING IMAGES ON GENERALLY CYLINDRICAL OBJECTS

[75] Inventors: Benzion Landa; Ishaian Lior, both of Nes Ziona; Yaacov Almog, Rehovot, all of Israel

[73] Assignee: Indigo N.V., Maastricht, Netherlands

[21] Appl. No.: 930,615

[22] PCT Filed: Jun. 6, 1995

[86] PCT No.: PCT/NL95/00189

§ 371 Date: Oct. 15, 1997

§ 102(e) Date: Oct. 15, 1997

[87] PCT Pub. No.: WO96/35150

PCT Pub. Date: Nov. 7, 1996

[30] Foreign Application Priority Data

Apr. 30, 1995 [IL] Israel ..... 113552

[51] Int. Cl.[6] ..... G03G 15/16; G03G 15/20

[52] U.S. Cl. ..... 399/297; 101/35; 399/296; 399/316; 399/338; 430/126

[58] Field of Search ..... 399/296, 297, 399/308, 313, 316, 318, 320, 338, 390; 430/126; 101/35, 36, 38.1; 219/216, 469; 156/240

[56] References Cited

U.S. PATENT DOCUMENTS

| | | | |
|---|---|---|---|
| 3,735,699 | 5/1973 | Koelschbach | 101/124 |
| 4,059,394 | 11/1977 | Ariyama et al. | 399/338 X |
| 4,519,310 | 5/1985 | Shimizu et al. | 101/35 |
| 4,684,238 | 8/1987 | Till et al. | 399/308 |
| 4,794,651 | 12/1988 | Landa et al. | 430/110 |
| 4,959,115 | 9/1990 | Lacy | 156/264 |
| 4,974,027 | 11/1990 | Landa et al. | 399/249 |
| 4,985,732 | 1/1991 | Landa et al. | 399/238 |
| 5,047,808 | 9/1991 | Landa et al. | 399/308 |
| 5,089,856 | 2/1992 | Landa et al. | 399/308 |
| 5,117,263 | 5/1992 | Adam et al. | 399/233 |
| 5,193,456 | 3/1993 | Wolfe et al. | 101/40 |
| 5,280,326 | 1/1994 | Pinhas et al. | 399/296 |
| 5,289,238 | 2/1994 | Lior et al. | 399/249 |
| 5,317,967 | 6/1994 | Heidenreich | 101/38.1 |
| 5,508,790 | 4/1996 | Belinkov et al. | 399/161 |
| 5,709,770 | 1/1998 | Ashgar et al. | 101/38.1 X |

FOREIGN PATENT DOCUMENTS

| | | |
|---|---|---|
| 0 323 097 | 7/1989 | European Pat. Off. . |
| 9004216 | 7/1989 | WIPO . |
| 9014619 | 11/1990 | WIPO . |
| 9213297 | 10/1992 | WIPO . |

*Primary Examiner*—Arthur T. Grimley
*Assistant Examiner*—Sophia S. Chen
*Attorney, Agent, or Firm*—Greenblum & Bernstein, P.L.C.

[57] ABSTRACT

Apparatus for printing images on generally cylindrical objects, such as cans, including: an image bearing surface having an image thereon; and an impression guide which is generally parallel to and spaced from the image bearing surface, which guide supports the cylindrical objects in rolling contact with the image bearing surface, whereby images are transferred from the image bearing surface to surfaces of the cylindrical objects in contact therewith.

29 Claims, 7 Drawing Sheets

APPARATUS FOR PRINTING IMAGES ON GENERALLY CYLINDRICAL OBJECTS

FIELD OF THE INVENTION

The present invention relates to printing of images in general and, more particularly, to devices and methods for printing images on a cylindrical surface.

BACKGROUND OF THE INVENTION

Multi-color printing on cylindrical objects, such as food or beverage cans, is well known.

In general, each can is centered on and rotates about a mandrel during the printing process. Afterwards, the can is filled and sealed, usually at another site.

The inability of the prior art to print on filled cans has several disadvantages. For example, placing the cans on a mandrel increases the time and cost of manufacture. In addition, customized printing is relatively expensive and logistically cumbersome, since printing and filling are generally carried out at different sites.

SUMMARY OF THE INVENTION

The present invention seeks to provide improved apparatus and methods for centerless multi-color printing on circularly cylindrical or elliptically cylindrical objects. Such objects may include images and designs and may be printed on objects such as cans before or even after full or partial filling with liquid, carbonated beverages or other fillings either vacuum packed or with a gas filling the nonliquid filled portions of the can, or other tubular objects such as bottles, pens, markers, etc. Images or designs may, in accordance with one embodiment of the invention, be printed directly onto elliptically cylindrical objects. Using the present invention, the cylindrical objects may be customized with greater ease and at lower cost than the prior art.

In simplified terms, cylindrical objects are brought into rolling contact with a printing device which prints on the surfaces of the objects as they roll about their own axis. More specifically, in accordance with a preferred embodiment of the present invention, the cylindrical objects are supported by an impression guide surface and brought into contact with a rotating toner image bearing surface of an imaging apparatus. Since the cylindrical objects contact both the impression guide surface and the toner image bearing surface, rotation of the image bearing surface causes the objects to roll about their own axis along the toner image bearing surface.

The rotating image bearing surface transfers an electrostatic image or design to the objects as they roll. There is no need for holding the objects on a guiding mandrel; the objects simply roll about their own axis and are printed as they roll.

The objects must be aligned with and conveyed to the rotating toner image bearing surface so that the images can be transferred onto the surfaces of the objects in a controlled manner. This is accomplished, in one embodiment of the invention by using a rotating dispenser which supplies the objects from to the impression guide surface. The dispenser incorporates a gating system designed to hold the objects and deliver them to the impression surface at the correct time so that they are aligned for proper transfer of images thereon from the image bearing surface.

Where the units being printed are short compared to the width of the image bearing surface, a plurality of units may be delivered, end to end, for simultaneous printing.

In a preferred embodiment of the invention, the gating system comprises a series of axial member disposed about the turning axis of the dispenser and may be disposed, in circumferentially disposed sets, axially along the dispenser. In a preferred embodiment of the invention, the dispenser dispenses two objects at a time to the image bearing surface for printing, the objects being spaced axially of each other. The rotating image bearing surface prints on the circumferential surfaces of the two objects during part of one revolution of the image bearing surface. The continuously turning image bearing surface then prints on the circumferential surfaces of a second set of axially spaced cylindrical objects during a second part of a revolution. There is a sufficient gap between printing on each set of two cylindrical objects to ensure that the objects do not touch and smear each other. Thus one printing cycle preferably includes one complete revolution of the image bearing surface and transfer of a plurality of images therefrom onto a plurality of objects.

Alternatively, the cylindrical objects may be delivered to the image bearing surface by a conveyer belt. This is especially useful when printing is to be performed on elliptically cylindrical objects for which both the position and orientation of the objects is important at the start of printing.

In a preferred embodiment of the invention two or more sets of two cylindrical objects are printed in one revolution of the image bearing surface.

A controller receives information from the image bearing surface and from the dispenser regarding relative rotational speeds and position of the images to be transferred with respect to the position of the objects. The controller adjusts the speed of conveyance and transfer of the objects such that the images are precisely transferred from the image bearing surface to the objects.

Generally, transfer from a heated image bearing surface fixes the images onto the cylindrical objects. In accordance with a preferred embodiment of the invention, heaters may be provided before and/or after transfer of the images to aid fixing the images. The heaters are preferably in direct, overhead contact with the cylindrical objects as they roll. Preheating must take into account whether the cans are filled or empty and whether the filling material is damaged by heat.

When printing is performed on very thin empty cans, it may be necessary to insert solid or hollow mandrels into the cans prior to the transfer of images thereto. In this case, the mandrel may be pre-heated prior to insertion and both post and pre-heating steps are preferably omitted. After image transfer to the cans, the somewhat cooler mandrels are removed and preferably reheated prior to reuse.

The present inventors have found that precoating cylindrical objects, especially metallic objects, with polyvinylpiridine homopolymer or with its copolymer with styrene provides for excellent transfer of ink with substantially no aging effects. Other useful adhesion There is therefore provided, in accordance with a preferred embodiment of the invention, apparatus for printing images, preferably toner or liquid toner images, on generally cylindrical objects, comprising:

an image bearing surface having an image thereon; and an impression guide which is generally parallel to and spaced from the image bearing surface, which guide supports said cylindrical objects in rolling contact with said image bearing surface, whereby images are transferred from said image bearing surface to surfaces of said cylindrical objects in contact therewith.

In a preferred embodiment of the invention, the apparatus comprises an object dispenser which conveys said cylindrical objects to said impression guide surface in timed relation with said image on said image bearing surface. Preferably, the object dispenser comprises a plurality of axially directed gates spaced circumferentially about an axis of said dispenser, wherein rotation of said dispenser about said dispenser axis conveys said cylindrical objects onto said impression guide surface. Preferably the apparatus comprises a plurality of object dispensers spaced axially along said dispenser axis.

In preferred embodiments of the invention the apparatus comprises a heater which heats heating said cylindrical objects before printing and/or a fixing heater which heats the objects after printing. Preferably, the heater comprises:

a hot plate; and a moving surface situated beneath and spaced from the hot plate by at a distance such that an object situated between the hot plate and the moving surface contacts both the hot plate and the moving surface.

In one preferred embodiment of the invention the cylindrical object is a generally circularly cylindrical object. In another it is a generally elliptically cylindrical object. As used herein elliptically cylindrical is used to include non-circularly cylindrical objects which may not be mathematical ellipses but which generally correspond to flattened circular cylinders.

In one preferred embodiment of the invention the impression guide comprises a substantially fixed, preferably elastomer coated, surface along which the cylindrical object is guided. In another it comprises a tensioned flexible surface along which the cylindrical surface is guided.

There is further provided fixing apparatus for fixing toner images, preferably, liquid toner images, on cylindrical objects such as cans partially filled with a liquid, the fixing apparatus comprising:

a hot plate; and a moving surface situated beneath and spaced from the hot plate by at a distance such that an object situated between the hot plate and the moving surface contacts both the hot plate and the moving surface.

There is further provided a method for printing images, preferably toner images or liquid toner images, on generally cylindrical objects, comprising:

conveying said cylindrical objects to an image bearing surface in timed relation with images on the image bearing surface;

supporting said cylindrical objects in rolling contact with said image bearing surface; and transferring said images from said image bearing surface to surfaces of said cylindrical objects when in contact therewith.

In a preferred embodiment of the invention the support includes supporting the cylindrical object with a support which is generally parallel to the image bearing surface along which the cylindrical object rolls along said support.

In a second preferred embodiment of the invention the support is a generally flexible support. In another it is a generally fixed support.

In a preferred embodiment of the invention the cylindrical objects are heated before and/or after printing.

Preferably the cylindrical objects are precoated with a polyvinylpyridine homopolymer or a polyvinylpyridine copolymer with styrene prior to printing thereon.

There is further provided, in accordance with a preferred embodiment of the invention, a method or printing toner images, preferably, liquid toner images on a metal surface including:

coating the metal surface with a polyvinylpyridine homopolymer or with a polyvinylpyridine copolymer with styrene; and printing the toner image on the coating.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENT

Figure 1:
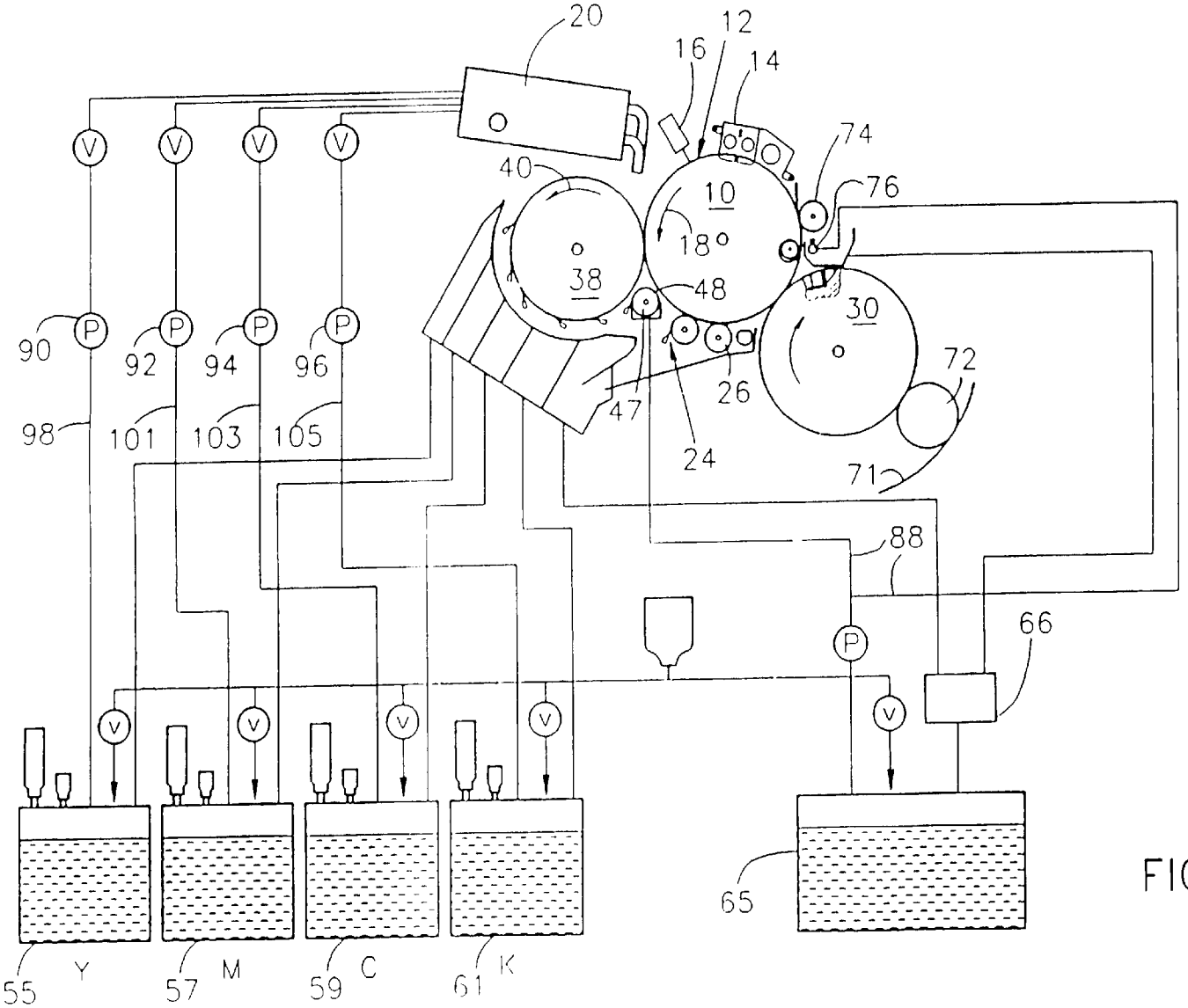
FIG. 1 is a simplified sectional illustration of electrostatic imaging apparatus constructed and operative in accordance with a preferred embodiment of the present invention.
Figure 2:
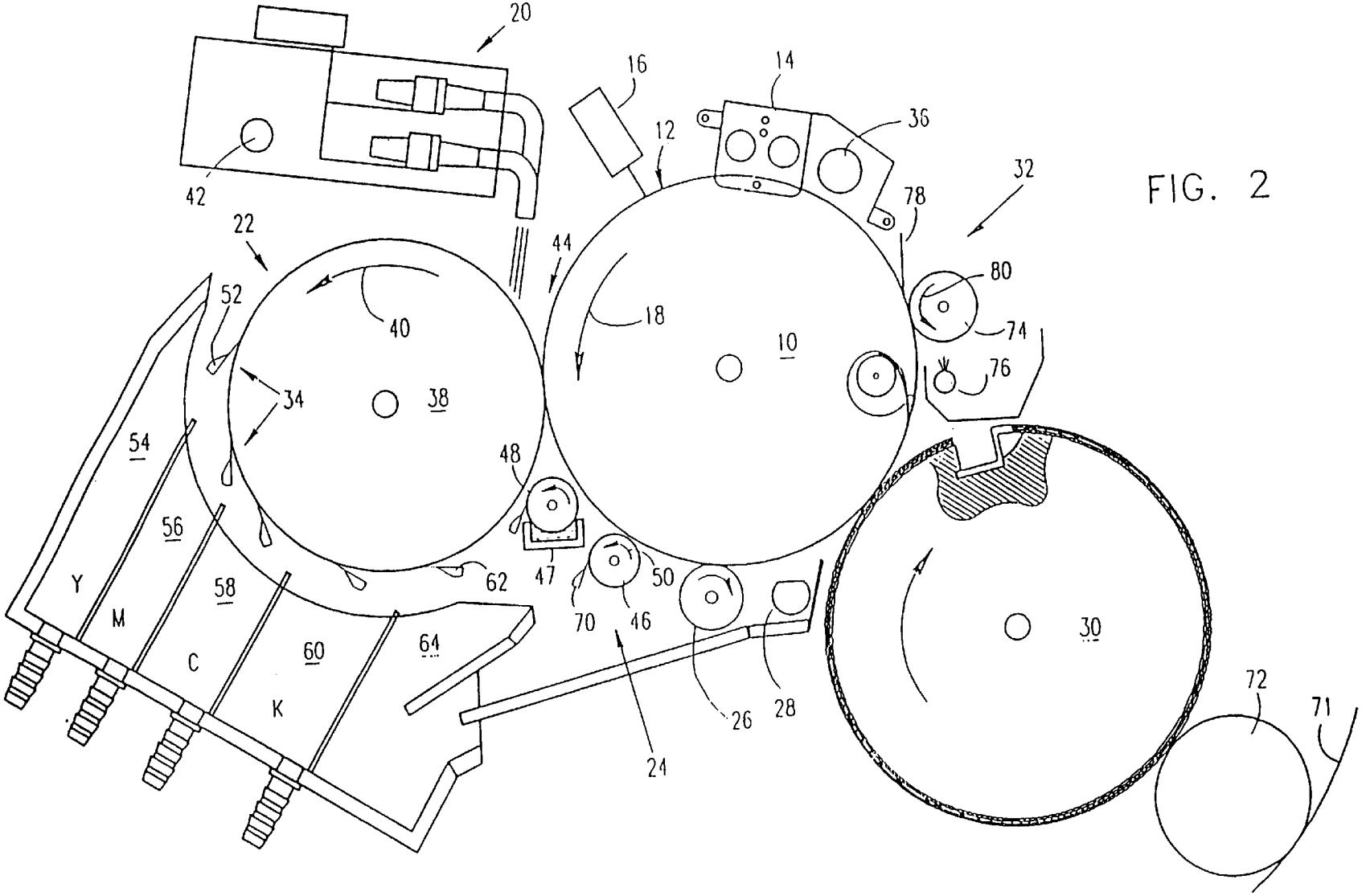
FIG. 2 is a simplified enlarged sectional illustration of the imaging apparatus of FIG. 1.

Reference is now made to FIGS. 1 and 2 which illustrate a multicolor printing or electrostatic imaging system, constructed and operative in accordance with a preferred embodiment of the present invention. As seen in FIGS. 1 and 2, an imaging sheet, preferably an organic photoreceptor 12, is mounted on a rotating drum 10. Drum 10 is rotated about its axis by a motor or the like (not shown), in the direction of arrow 18, past charging apparatus 14, preferably a corotron, scorotron or roller charger or other suitable charging apparatus as are known in the art which is adapted to charge the surface of sheet photoreceptor 12. An image to be reproduced is focused by an imager 16 upon the charged surface 12 at least partially discharging the photoconductor in the areas struck by light, thereby forming an electrostatic latent image. Thus, the latent image normally includes image areas at a first electrical potential and background areas at a second electrical potential.

Photoreceptor sheet 12 may use any suitable arrangement of layers of materials as is known in the art, however, in the preferred embodiment of the photoreceptor sheet, certain of the layers are removed from the ends of the sheet to facilitate its mounting on drum 10.

This preferred photoreceptor sheet and preferred methods of mounting it on drum 10 are described in a copending application of Belinkov et al., IMAGING APPARATUS AND PHOTORECEPTOR THEREFOR, filed Sep. 7, 1994, assigned serial number 08/301,775 now U.S. Pat. No. 5,508,790 and corresponding patent applications filed in other countries, the disclosure of which is incorporated herein by reference. Alternatively, photoreceptor 12 may be deposited on drum 10 and may form a continuous surface. Furthermore, photoreceptor 12 may be a non-organic type photoconductor based, for example, on a compound of selenium.

It should be noted that in other, alternative, preferred embodiments of the invention, non-electrophotographic methods may be used for generating the electrostatic latent image. For example, the latent image may be a changeable or a permanent latent image generated by ionographic or other electrostatic image forming means.

In a preferred embodiment of the present invention, imager 16 is a modulated laser beam scanning apparatus, or other laser imaging apparatus, such as is known in the art.

Also associated with drum 10 and photoreceptor sheet 12, in the preferred embodiment of the invention, are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36.

Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the electrostatic latent image.

Development roller 38 typically rotates in the same sense as drum 10 as indicated by arrow 40. This rotation provides for the surface of sheet 12 and development roller 38 to have opposite velocities at the gap between them.

Multicolor liquid developer spray assembly 20, whose operation and structure is described in detail in U.S. Pat. No. 5,117,263, the disclosure of which is incorporated herein by reference, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, assembly 20 may be fixed. Preferably, the spray is directed onto a portion of the development roller 38.

Color specific cleaning blade assemblies 34 are operatively associated with development roller 38 for separate removal of residual amounts of each colored toner remaining thereon after development. Each of blade assemblies 34 is selectably brought into operative association with development roller 38 only when toner of a color corresponding thereto is supplied to development region 44 by spray assembly 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the development roller 38 to separate collection containers 54, 56, 58, and 60 for each color to prevent contamination of the various developers by mixing of the colors. The different color toners collected by collection containers 54, 56, 58 and 60 are recycled to corresponding toner reservoirs 55, 57, 59 and 61. A final toner directing member 62 always engages the development roller 38 and the toner collected thereat is supplied into collection container 64 and thereafter to a carrier-liquid reservoir 65 via a separator 66 which is operative to separate relatively clean carrier liquid from the various colored toner particles. The separator 66 may be typically of the type described in U.S. Pat. No. 4,985,732, the disclosure of which is incorporated herein by reference.

In a preferred embodiment of the invention, as described in PCT Publication WO 92/13297, the disclosure of which is incorporated herein by reference, where the imaging speed is very high, a background cleaning station 24 typically including a reverse roller 46 and a wetting roller 48 is provided. Reverse roller 46 which rotates in a direction indicated by arrow 50 is preferably electrically biased to a potential intermediate that of the image and background areas of photoconductive drum 10, but different from that of the development roller 38. Reverse roller 46 is preferably spaced apart from photoreceptor sheet 12 thereby forming a gap therebetween which is typically 40 to 150 micrometers.

Wetting roller 48 is preferably partly immersed in a fluid bath 47, which preferably contains carrier liquid received from carrier liquid reservoir 65 via a conduit 88. Wetting roller 48, which preferably rotates in the same sense as that of drum 10 and reverse roller 46, operates to wet photoreceptor sheet 12 with non-pigmented carrier liquid upstream of reverse roller 46. The liquid supplied by wetting roller 48 replaces the liquid removed from drum 10 by development assembly 22, thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via collection container 64 and separator 66.

Wetting roller 48 is preferably electrically biased to a potential intermediate that of the image and background areas of photoconductive drum 10, but lower than that of the development roller. This biasing of wetting roller 48 assists in removing toner particles from the background areas of photoreceptor sheet 12. Wetting roller 48 is preferably spaced apart from photoreceptor sheet 12 thereby forming a gap therebetween which is typically 40 to 200 micrometers.

Apparatus embodied in reference numerals 46, 47, 48 and 70 is generally not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

Discharge device 28 is operative to flood sheet 12 with light which discharges the voltage remaining on sheet 12, mainly to reduce electrical breakdown and improve transfer of the image to intermediate transfer member 30. Operation of such a device in a "write black" system is described in U.S. Pat. No. 5,280,326, the disclosure of which is incorporated herein by reference.

FIGS. 1 and 2 further show that multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and, optionally Black, respectively. Pumps 90, 92, 94 and 96 may be provided along respective supply conduits 98, 101, 103 and 105 for providing a desired amount of pressure to feed the colored toner to multicolor spray assembly 20. Alternatively, multicolor toner spray assembly 20, which is preferably a three level spray assembly, receives supplies of colored toner from up to six different reservoirs (not shown) which allows for custom colored tones in addition to the standard process colors.

A preferred type of toner for use with the present invention is that described in Example 1 of U.S. Pat. No. 4,794,651, the disclosure of which is incorporated herein by reference or variants thereof as are well known in the art. For colored liquid developers, carbon black is replaced by color pigments as is well known in the art. Other toners may alternatively be employed, including liquid toners and, as indicated above. Preferred liquid toners are also described in the various patents and patent applications referred to herein and/or incorporated herein by reference.

Toners that can be used with the present invention are described in Example 1 of U.S. Pat. No. 4,794,651, the disclosure of which is incorporated herein by reference or variants thereof as are well known in the art. For colored liquid developers, carbon black is replaced by color pigments as is well known in the art. Other toners may alternatively be employed, including liquid toners and, as indicated above, including powder toners.

Other toners for use in the invention can be prepared using the following method:

1) Solubilizing 1400 grams of Nucrel 925 (ethylene copolymer by Dupont) and 1400 g of Isopar L (Exxon) are thoroughly mixed in an oil heated Ross Double Planetary Mixer at least 24 RPM for 1.5 hours, with the oil temperature at 130° C. 1200 g of preheated Isopar L is added and mixing is continued for an additional hour. The mixture is cooled to 45° C., while stirring is continued over a period of several hours, to form a viscous material.

2) Milling and Grinding 762 grams of the result of the Solubilizing step are ground in a 1S attritor (Union Process Inc. Akron Ohio), charged with 3/16" carbon steel balls at 250 RPM, together with 66.7 grams of Mogul L carbon black (Cabot), 6.7 grams of BT 583D (blue pigment produced by Cookson), 5 grams of aluminum stearate (Riedel Dehaen) and an additional 1459.6 grams of Isopar L for eight hours at 30° C.

3) Continuation of Grinding In one embodiment of the invention an additional grinding step is performed. In this step 34.5 grams of ACumist A-12 (a micronised polyethylene wax produced by Allied Signal) is added after step 2 and grinding is continued for an additional 4 hours. The resulting particles are fibrous particles have a measured diameter in the range of 1–3 micrometers.

The resulting material is diluted with additional Isopar L and Marcol 82 to give a working developer in which the dry solids portion is about 1.7% and in which the overall ratio of Isopar L to Marcol is between about 50:1 and 500:1, more preferably between about 100:1 and 200:1. Charge director as described in U.S. patent application Ser. No. 07/915,291 (utilizing lecithin, BBP and ICIG3300B) and in WO 94/02887, in an amount approximately equal to 40 mg/gm of solids in the final dispersion, is added to charge the toner particles. Other charge directors and additional additives as are known in the art may also be used.

The above described process produces a black toner. Cyan, magenta and yellow toners can be produced by using a different mix of materials for step 2). For Cyan toner, 822 g of the solubilized material, 21.33 grams each of BT 583D and BT 788D pigments (Cookson), 1.73 grams of D1355DD pigment (BASF), 7.59 grams of aluminum stearate and 1426 grams of Isopar L are used in step 2. For Magenta toner, 810 grams of solubilized material, 48.3 grams of Finess Red F2B, 6.81 grams of aluminum stearate and 1434.2 grams of Isopar L are used in step 2. For yellow toner 810 grams of solubilized material, 49.1 grams of D1355DD pigment, 6.9 grams of aluminum stearate and 1423 grams of Isopar L are used in step 2.

Intermediate transfer member (ITM) 30 may be any suitable intermediate transfer member, for example, as described in U.S. Pat. Nos. 4,684,238 and 4,974,027 or in PCT Publication WO 90/04216, the disclosures of which are incorporated herein by reference. Alternatively, in a preferred embodiment of the invention, ITM 30 has a multilayered transfer portion such as those described below or in U.S. Pat. Nos. 5,089,856 and 5,047,808, or in U.S. patent application Ser. No. 08/371,117 now U.S. Pat. No. 5,745,829, filed Jan. 11, 1995 and entitled IMAGING APPARATUS AND INTERMEDIATE TRANSFER BLANKET THEREFOR, the disclosures of all of which are incorporated herein by reference. In a preferred embodiment of the invention a softer than normal intermediate transfer member is used and is produced according to the following method.

Figure 7:
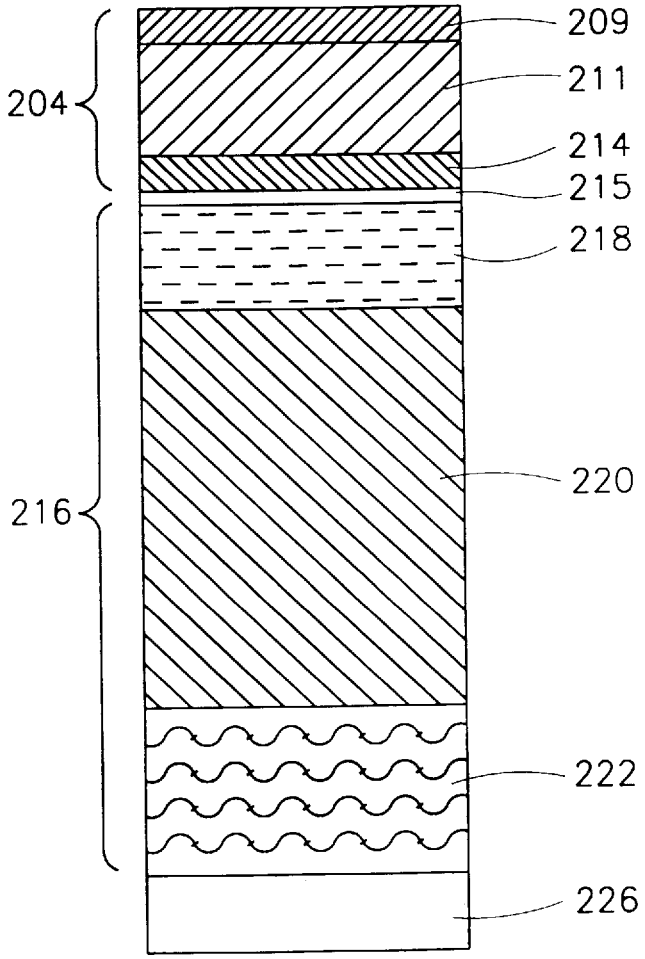
FIG. 7 is a simplified cut of an intermediate transfer member suitable for use in the apparatus of FIG. 1.

FIG. 7 shows a transfer portion 204 comprises a release layer 209 which is outermost on the blanket when it is mounted on drum 30. Underlying layer 209 is a conforming layer 211 preferably of a soft elastomer, preferably of polyurethane and preferably having a Shore A hardness of about 40, although other hardnesses between about 30 and 60 are also sometimes suitable. Underlying layer 211 is a conductive layer 214 which overlays a thin barrier layer 215. Barrier layer 215 overlays a blanket body 216 comprising a top layer 218, a compressible layer 220 and a fabric layer 222. Underlying the fabric layer is preferably an adhesive layer 226 which is in contact with the core of drum 30.

1—The starting structure for blanket construction is a blanket body 216 generally similar to that generally used for printing blankets. One suitable body is MCC-1129-02 manufactured and sold by Reeves SpA, Lodi Vecchio (Milano), Italy. Other preferred blanket bases have been described previously in the parents of parents of U.S. patent application Ser. No. 08/371,117 now U.S. Pat. No. 5,745,829, which are incorporated herein by reference. In a preferred embodiment of the invention, body 216 comprises a fabric layer 222, preferably of woven NOMEX material and having a thickness of about 200 micrometers, a compressible layer 220, preferably comprising about 400 micrometers of saturated nitrile rubber loaded with carbon black to increase its thermal conductivity. Layer 220 preferably contains small voids (about 40–60% by volume) and a top layer 218 preferably comprised of the same material as the compressible layer, but without voids. Layer 209 is preferably about 100 micrometers thick. The blanket body is produced by manufacturing methods as are generally used for the production of offset printing blankets for ink offset printing.

Blanket body 216 is preferably sized to a relatively exact thickness by abrading portions of the surface of top layer 218. A preferred thickness for the finished body 216 is about 700 micrometers, although other thicknesses are useful, depending on the geometry of the printing system in which it is used and the exact materials used in the blanket body.

2—The fabric side of blanket body 216 is preferably coated with a 30 micrometer thick coating of silicone based adhesive (preferably, Type D 66 manufactured by Dow Corning) for mounting onto the core.

3—Top layer 218 is preferably coated with a sub-micron layer of primer before being coated with additional layers. A preferred primer is Dow Corning 1205 Prime Coat. The type of primer depends on the properties of the top layer and of the conductive layer. Preferably, 0.3 micron of primer is coated onto a clean top layer with a No. 0 bar in a wire-rod coating apparatus and is allowed to dry before applying the conductive layer.

4—Since blanket body 216 may contain materials such as anti-oxidants, anti-ozonants or other additives which may migrate through the upper layers of the blanket, for example as a gas when the blanket is heated during the imaging process and/or in the presence of carrier liquid such as Isopar L, barrier layer 215 is preferably coated onto top layer 218 (or more exactly onto the primer). This barrier layer should be substantially impervious to such materials in the blanket body which may migrate and/or to the carrier liquid which is used.

If this layer is omitted, under certain circumstances the additive materials can cause deterioration of the photoreceptor. In particular, it was found that the imaging process may become humidity dependent.

In a preferred embodiment of the invention, a 4–11 micrometer layer of polyvinyl alcohol (88% hydrolyzed) is coated onto the primer layer covering top layer 218.

Polyvinyl alcohol, 88% hydrolyzed, having an average molecular weight preferably between 85,000 and 145,000 (Aldrich Chemical Co. Inc., Milwaukee, Wis.) is dissolved in water at 90° C. by continuously stirring the mixture in a reflux system for 30 minutes. After 30 minutes, a quantity of ethanol equal to twice the quantity of water is added to the solution, the resulting polyvinyl alcohol concentration being preferably less than 10%. Higher concentration solutions can be used; however, they give a more viscous solution which is hard to spread evenly.

The solution is deposited on layer 218 of body 216 using a fine wire rod or knife inclined at 30°–45° to the direction of movement of the knife or body. The solvent is evaporated either by drying at room temperature or by blowing hot air on the layer.

One or more coating passes are employed to give the required thickness.

Too thin a layer will result in some transfer of material from body 216, which has been correlated with reduced transfer efficiency from the photoreceptor to the intermediate transfer blanket, which is believed to be caused by photoreceptor deterioration. While four micrometers of material appears to be sufficient to avoid leaching, a somewhat larger thickness such as 6 micrometers is preferably used.

Other barrier materials and other thicknesses may be used depending on the carrier liquid used for the toner or the gasses omitted by body 216. Other barrier materials may require lesser or greater thickness depending on their resistance to the carrier liquid or the gasses released by body 216. Alternatively, if body 216 resists leaching by the carrier liquid or does not contain materials which are released (especially when body 216 is heated) or any anti-oxidants and/or anti-ozonants, layer 215 may be omitted.

Polyvinyl alcohol is a thermoplastic crystalline material having a melting point which is higher than the temperature of the blanket during operation. Polyvinyl alcohol is also believed to form a layer which is impervious to gasses and to the hydrocarbon carrier liquid used in the liquid toner.

5—Conductive layer 214 is preferably formed of acrylic rubber loaded with conductive carbon black. In a preferred embodiment of the invention, only 2–3 micrometers of conductive coating are required. The conductive layer is formed by first compounding 300 grams of Hytemp 4051EP (Zeon Chemicals) with 6 grams of Hytemp NPC 50 and 9 grams of sodium stearate in a two-roll mill for 20 minutes; and then dissolving 150 grams of the compounded material in 2000 grams of methyl ethyl ketone (MEK) by stirring for 12 hours at room temperature.

40 grams of conductive carbon black, such as, for example, Printex XE2 (Degussa) are added to the solution and the mixture is ground in a 01 attritor (Union Process) loaded with 3/16" steel balls. Grinding proceeds at 10° C. for 4 hours after which time the material is diluted by the addition of MEK to a concentration of 7.5–8% solids and discharged from the grinder in the form of a conductive lacquer.

The blanket (after step 3 or step 4) is overcoated with about 3 micrometers of the conductive lacquer (three passes using a No. 0 rod) and allowed to dry for 5 minutes at room temperature.

An additional coating of primer is added over the conductive lacquer (except for the portion which is to be inserted into bar 108, as described hereinbelow) before the soft elastomeric conforming layer is applied.

The resistance of the conductive layer should preferably be more than about 20 kohms/square and preferably less than about 50 kohm/square. This value will depend on the resistivity of the layers above the conducting layer and on the aspect ratio of the blanket. In general, the resistance should be low enough so that the current flowing on the conducting layer (to supply leakage current through the overlying layers) should not cause a substantial variation of voltage along the surface of the blanket. The resistance of the conducting layer and, more importantly, the resistance of the overlying layers control the current flowing through the overlying layers. Generally speaking, the conductive layer has a relatively low resistance and resistivity, the conforming layer (layer 211) has a higher resistivity and the overlying release layer (layer 209) has a still higher resistivity.

6—One kilogram of pre-filtered Fomrez-50 polyester resin (Hagalil Company, Ashdod, Israel) is dehydrated and degassed under vacuum at 60° C. 660 grams of the degassed material is mixed with 1.4 grams of di-butyl-tin-diluarate (Aldrich) and degassed at room temperature for 2 hours. 33 grams of the resulting material, 3.5 grams of RTV Silicone 118 (General Electric) and 4.0 grams of Polyurethane cross-linker, DESMODUR 44V20 (Bayer) are stirred together. A 100 micrometer layer of the material is coated over the primed conductive layer using a No. 3 wire rod with several passes under clean conditions, preferably, class 100 conditions. The coating is cured for two hours at room temperature under a clean hood to form a polyurethane layer.

Other methods of forming suitable conforming layers are shown and described in the parents of U.S. patent application Ser. No. 08/371,117 now U.S. Pat. No. 5,745,829. Alternatively, the conductive layer may be omitted and layer 218 made conductive.

Layer 211 which is thus formed should have a resisivity of the order of about $10^9$ ohm-cm, good thermal stability at the working temperature of the blanket surface, which is preferably about 100° C. or less.

The function of the conforming layer is to provide good conformation of the blanket to the image forming surface (and the image on the image forming surface) at the low pressures used in transfer of the image from the image forming surface to the blanket. While a thickness of 100 micrometers is preferred, other thicknesses, between 50 micrometers and 300 micrometers can be used, with 75 to 125 micrometers being preferred.

7–9 grams of RTV silicone 236 (Dow Corning) release material and 3 grams RTV 118 (General Electric) and 0.72 grams of Syl-off 297 (Dow Corning) are mixed together. A wire rod (bar No. 1) coating system is used, with five or six passes, under clean conditions to achieve an 8 micrometer release layer thickness. The material is cured at 140° C. for two hours. The cured release material has a resistivity of approximately $10^{14}$ to $10^{15}$ ohm-cm.

Member 30 is maintained at a suitable voltage and temperature for electrostatic transfer of the image thereto from the toner image bearing surface of photoreceptor 12.

Figure 3:
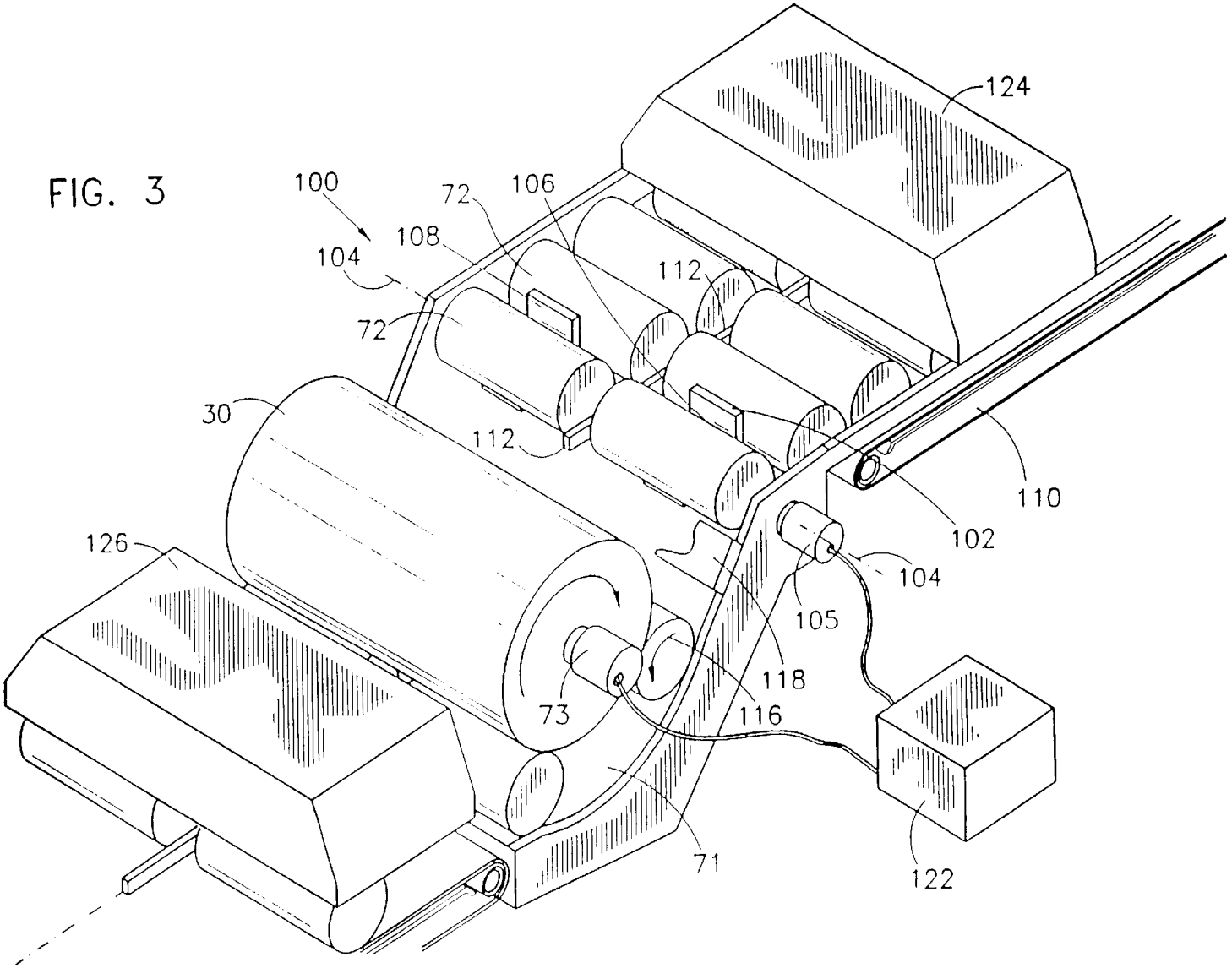
FIG. 3 is a simplified pictorial illustration of a portion of a conveyor device constructed and operative in accordance with a preferred embodiment of the present invention.

Intermediate transfer member 30 preferably transfers the image onto the surfaces of generally cylindrical objects 72, such as full or empty tin coated steel or aluminum cans, which roll between member 30 and an impression guide surface 71, preferably by heat and pressure. Impression guide surface 71 is preferably made of a compliant, non-slip material such as neoprene or synthetic rubber. Member 30 is preferably rotated by a motor 73, such as a servomotor or the like, as shown in FIG. 3.

A conveyor device 100 for transporting cylindrical objects 72 is described hereinbelow in greater detail with reference to FIGS. 3, 4 and 5.

Cleaning apparatus 32 is operative to scrub clean the surface of photoreceptor 12 and preferably includes a cleaning roller 74, a sprayer 76 for spraying a non polar cleaning liquid, preferably cool and fresh carrier liquid from reservoir 65, and a wiper blade 78 to complete the cleaning of the photoconductive surface. The sprayed carrier liquid assists in the scrubbing process and cools the photoreceptor surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given color, the single color image is transferred to intermediate transfer member 30. Subsequent images in different colors are sequentially formed on sheet 12 and electrostatically transferred, in alignment with the previous images, onto intermediate transfer member 30. When all of the desired images have been transferred thereto, the complete multicolor image is transferred from transfer member 30 to the surfaces of the cylindrical objects 72, preferably by heat and pressure. Impression guide surface 71 produces resilient operative engagement between intermediate transfer member 30 and cylindrical objects 72 when transfer of the composite images to cylindrical objects 72 takes place.

It should be understood that the invention is not limited to the specific type of image forming system used and the present invention is also useful with any suitable imaging system. The specific details given above for the image forming system are included as part of a best mode of carrying out the invention, however, many aspects of the invention are applicable to a wide range of systems as known in the art for electrostatic and offset ink printing and copying. Furthermore, other specific details of the present image forming system, some of which may be part of the best mode of carrying out the invention, are included in the publications incorporated herein by reference.

Figure 4:
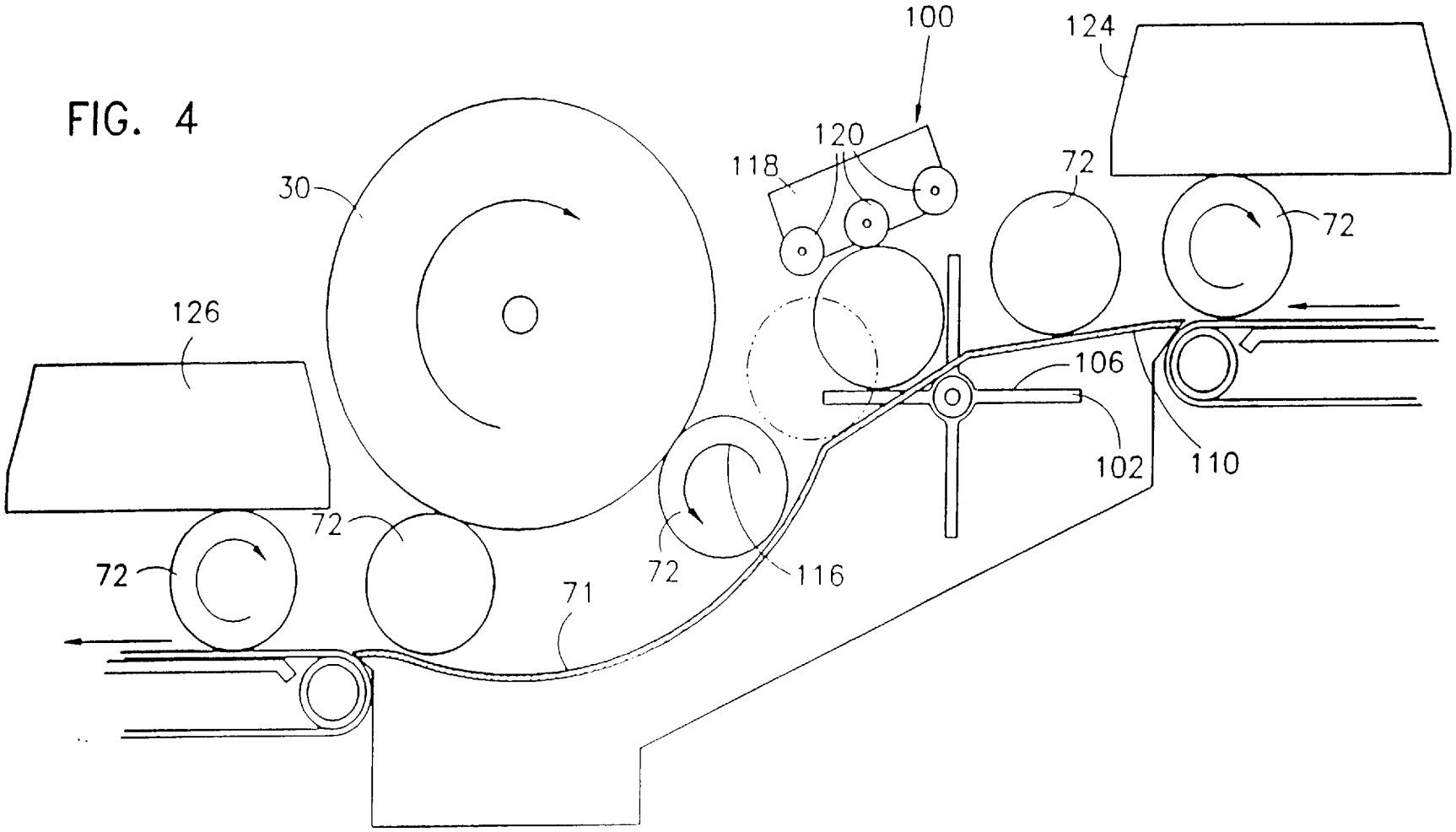
FIG. 4 is a simplified side view illustration of a portion of the conveyor device of FIG. 3.

Reference is now made to FIGS. 3 and 4 which illustrate conveyor device 100. Device 100 conveys circularly cylindrical objects 72 in timed relation with the toner image bearing surface of the intermediate transfer member 30, in accordance with a preferred embodiment of the present invention. Conveyor device 100 preferably includes an object dispenser 102, which is rotated about an axis 104 by a motor 105, such as a servomotor or the like, the operation of which is controlled by a controller 122, as described in detail hereinbelow.

A plurality of gate arms 106 are axially directed and circumferentially spaced on dispenser 102, each gate being adapted to pass one of cylindrical objects 72 when it is rotated in a counterclockwise direction. Alternatively, or additionally, groups of gates 106 may be axially spaced along the dispenser 102. As an example, FIGS. 3 and 4 illustrate two axially spaced groups of gates 106, each group comprising four gates 106 spaced circumferentially about the axis 104. The groups are preferably separated from each other by a partition 108. Partition 108 is optional and may be removed especially where the cans or other objects nest into each other as is often the case with one piece aluminum can bodies.

In a preferred embodiment of the present invention, a conveyor belt 110, located upstream of the object dispenser 102, conveys cylindrical objects 72 to dispenser 102. Conveyor belt 110 includes partitions 112 which are sized and arranged for transferring the cylindrical objects 72 into gates 106 of dispenser 102. As seen best in FIGS. 4, dispenser 102 is located somewhat below conveyor belt 110 and in juxtaposition therewith, such that cylindrical objects 72 exit conveyor belt 110 and generally smoothly enter gates 106.

Impression guide surface 71 is located somewhat below dispenser 102 and is substantially parallel to a portion of the intermediate transfer member 30 where transfer of images takes place, as seen in FIGS. 3 and 4A. As seen best in FIG. 4A, each cylindrical object 72 exits its corresponding gate 106, drops onto impression guide surface 71 and comes into contact with intermediate transfer member 30. Since cylindrical objects 72 contact both impression guide surface 71 and intermediate transfer member 30, rotation of intermediate transfer member 30 causes each cylindrical object 72 to roll about its own axis in a direction indicated by arrow 116.

An overhead guide 118, fully shown in FIGS. 4 and partially shown in FIG. 3, is preferably located generally above the area where the cylindrical objects 72 start to enter and exit gates 106, to guide cylindrical objects 72 into the gates and in their drop onto impression guide surface 71. Overhead guide 118 preferably comprises one or more idler rollers 120.

In accordance with a preferred embodiment of the present invention, a controller 122 is provided which coordinates conveyance of cylindrical objects 72 from conveyor device 100 to intermediate transfer member 30, such that images are transferred from intermediate transfer member 30 to the surfaces of the cylindrical objects 72 in a predetermined manner. Controller 122 is preferably in electrical communication with motors 105 and 73 which respectively control rotation of dispenser 102 and rotation of intermediate transfer member 30, and may be in electrical communication with motors which control movement of the conveyor belt 110 and other parts of the printing device as well, such as drum 10. Controller 122 also communicates with intermediate transfer member 30 and receives information therefrom regarding the position of images on member 30. The controller 122 ensures proper registration of the cylindrical objects 72 as they come into printing contact with intermediate transfer member 30.

Figure 5:
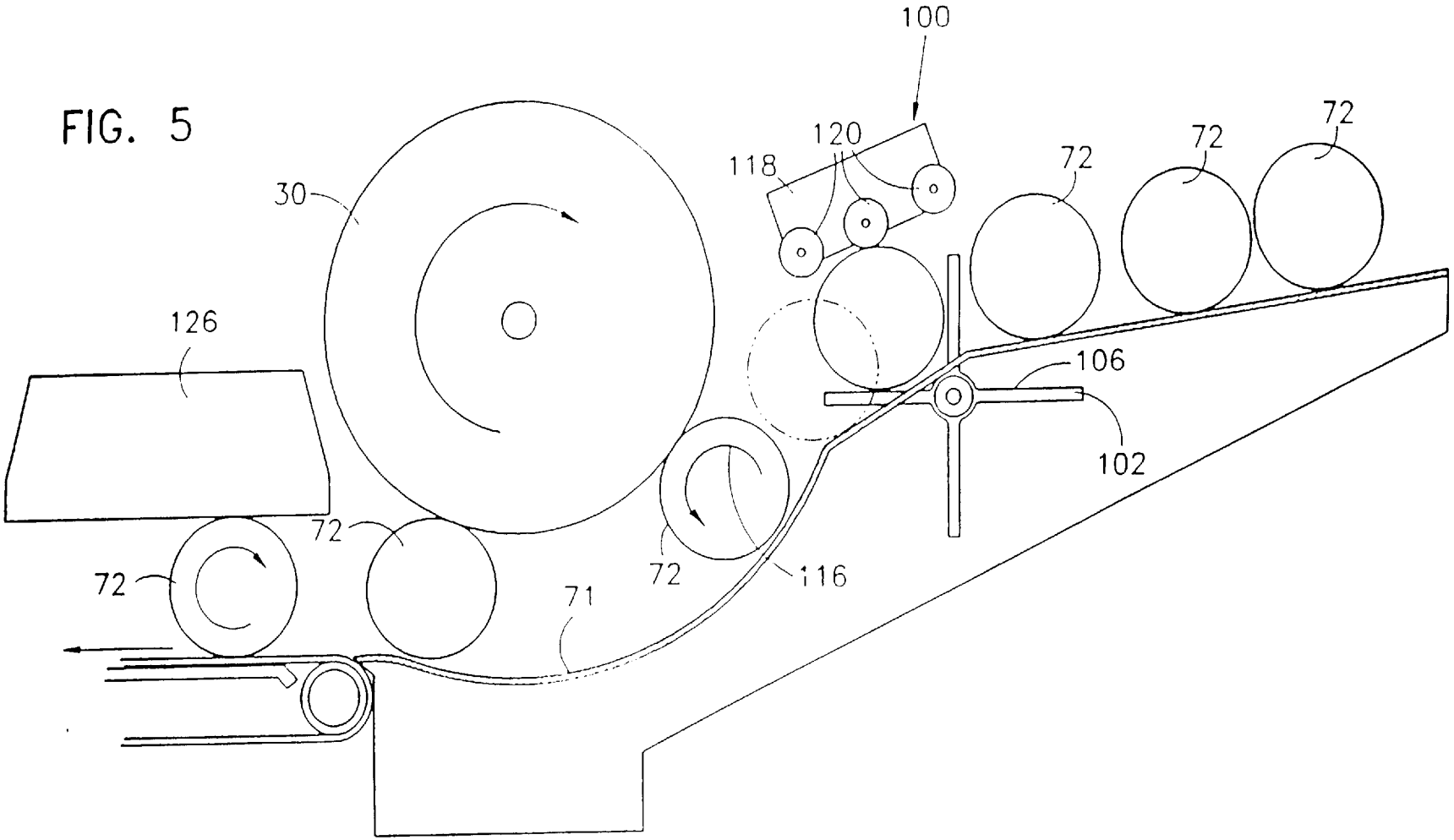
FIG. 5 is a simplified side view illustration of a portion of an alternate conveyer device similar to that of FIG. 3, in accordance with a preferred embodiment of the invention.

FIG. 5 shows a system, similar to that of FIG. 4, in which the cylindrical objects are gravity fed directly into the gates. Such a system has been found to operate well with a feed slope of about 5%. Use of a much smaller slope results in poor feeding of the objects. A higher feed slope will result in additional pressure on the gate. This can be reduced by providing intermediate gates along the slope to reduce the pressure on any one gate.

In the preferred embodiment illustrated in FIGS. 3, 4 and 5, each image transferred from member 30 includes four sub-images, one for each cylindrical object 72, such that each printing cycle includes printing on four cylindrical objects 72. Of course, where smaller objects or a larger drum 30 is used, more objects are printed per rotation of drum 30.

Additionally in accordance with a preferred embodiment of the present invention, there is provided a heater 124 for heating cylindrical objects 72 before printing, as shown in FIGS. 3 and 4. Heater 124 is preferably located above conveyor belt 110 upstream of the conveyor drum 102 and in contact with cylindrical objects 72. Pre-heating of cylindrical objects 72, especially empty cans may help in fixing the image.

It should be noted that transfer from a heated intermediate transfer member generally fixes the images. However, if additional fixing is required, an optional fixing heater 126, preferably a hot plate at a temperature of about 200° C. is provided for heating the cylindrical objects 72 after printing to give improved fixing of the transferred and fixed images, as shown in FIG. 3. Heater 126 is preferably located directly above and in contact with cylindrical objects 72 downstream of impression guide surface 71.

Cylindrical objects which contain food or beverages are not normally completely filled, but rather an air or gas filled gap, or substantially evacuated gap, exists between the uppermost portion of the envelope of the cylindrical objects and their contents. Each cylindrical object is conveyed under heaters 124 and 126 in a horizontal orientation, so that this space lies between the contents and the inner top surface of the cylindrical object. This gap helps to thermally insulate the contents of the cylindrical objects from the thermal energy of heaters 124 and 126 and thereby help prevent thermal damage. The gap also enables a relatively high surface temperature to be reached to give good fixing, without the contents carrying away the heat.

Temperature control apparatus may also be provided to ensure that heaters 124 and 126 do not cause thermal damage to the contents of cylindrical objects 72.

Generally, to provide suitable fixing it is necessary for cans 72 to be subject to heater 126 for a long time. In order to provide an efficient and compact fixer and fuser, cans 72 travel at a much slower speed through the fuser than when they are printed. Since printing on the cylindrical objects takes place only once every n rotations thereof, where n is the number of colors in the image, the speed in the fuser may be several times slower than the speed of the cans in the image transfer region without any pile-up of cans occurring.

Figure 6:
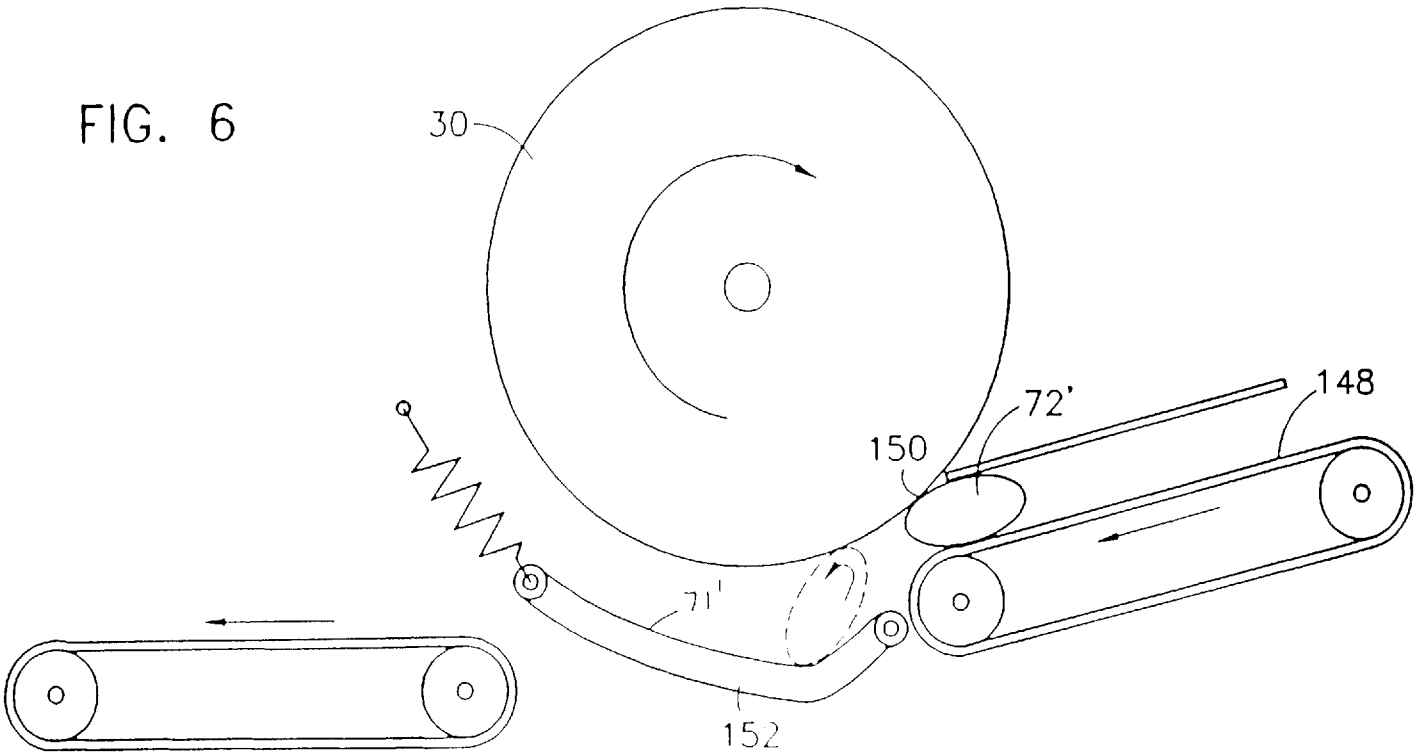
FIG. 6 is a simplified schematic side view illustration of a portion of an alternate conveyer device, suitable for printing on both circularly cylindrical and elliptically cylindrical objects, in accordance with a preferred embodiment of the invention.

FIG. 6 shows a schematic representation of a system for printing on the surface of elliptically cylindrical objects. In this embodiment of the invention, an elliptical cylindrical object 72' is brought to the image bearing surface of 30 by a conveyer belt 148 timed to bring the object to a first meeting point 150 together with a corresponding image on the image bearing surface of drum 30. Object 72' is fed by belt 148 and drum 30 into contact with an impression guide surface 71' which is the surface of a tensioned flexible and possibly somewhat elastic belt 152 which is pivotably fixed at its right end. The left end of belt 152 is tensioned by a spring which allows the distance between the portion of belt 71' beneath object 72' and drum 30 to vary as the elliptically cylindrical object 72' rolls along the belt under the influence of the drum. During this rolling action the belt maintains pressure between object 72' and the drum and the image is transferred to the object from the drum under the influence of heat and pressure. At the end of the printing process, the object is removed from the belt either by gravity (as in the embodiment shown) or by some other means.

Some cans or other metallic cylindrical objects are sometimes precoated by epoxy paint or other white coating, as is known in the art.

The present inventors have found that precoating cylindrical objects with a polymer having basic moieties on their backbone, such as, polyvinylpyridine homopolymer or with its copolymer with styrene prior to printing provides for excellent transfer of ink with substantially no aging effects. Other useful adhesion promoters are EVA (ethylene vinyl acetate) or hot melt adhesives such as members of the Macromelt family and particularly Macromelt 6239.

If additional protection of the image is desired, it may be coated with a protective coating of a lacquer or other protective substance.

It will be appreciated by persons skilled in the art that the present invention is not limited by the description and example provided hereinabove. Rather, the scope of this invention is defined only by the claims which follow:

We claim:

1. Apparatus for printing images on generally cylindrical objects, comprising:

an image bearing surface having an image thereon; and a guide which is generally parallel to and spaced from the image bearing surface, which guide supports said generally cylindrical objects in rolling contact with said image bearing surface and with said guide, whereby images are transferred from said image bearing surface to a surface of said generally cylindrical objects in contact therewith.

2. Apparatus according to claim 1 and comprising an object dispenser which conveys said generally cylindrical objects to said guide in timed relation with said image on said image bearing surface.

3. Apparatus according to claim 2 and wherein said object dispenser comprises a plurality of axially directed gates spaced circumferentially about an axis of said dispenser, wherein rotation of said dispenser about said dispenser axis conveys said generally cylindrical objects onto said guide.

4. Apparatus according to claim 3 and comprising a plurality of object dispensers spaced axially along said dispenser axis.

5. Apparatus according to claim 1 and further comprising a heater for heating said cylindrical objects before printing.

6. Printing apparatus according to claim 5 wherein said heater comprises:

a hot plate; and a moving surface situated beneath and spaced from the hot plate by a distance such that an object situated between the hot plate and the moving surface contacts both the hot place and the moving surface.

7. Apparatus according to claim 1 and further comprising a fixing heater for heating said generally cylindrical objects after printing.

8. Printing apparatus according to claim 7 wherein said fixing heater comprises:

a hot plate; and a moving surface situated beneath and spaced from the hot plate by at a distance such that an object situated between the hot plate and the moving surface contacts both the hot plate and the moving surface.

9. Apparatus according to claim 1 wherein the generally cylindrical object are generally circularly cylindrical object.

10. Apparatus according to claim 1 wherein the guide comprises a substantially fixed surface along which the generally cylindrical objects are guided.

11. Apparatus according to claim 10 wherein the substantially fixed surface comprises an elastomer coating.

12. Apparatus claim 1 wherein the generally cylindrical object are generally elliptically cylindrical object.

13. Apparatus accordingly claim 1 according to claim 1 wherein the guide comprises a tensioned flexible surface along which the generally cylindrical surface is guided.

14. Printing apparatus according to claim 1 wherein the image is a toner image.

15. Apparatus according to claim 14, wherein the toner image is a liquid toner image comprising pigmented toner particles and carrier liquid.

16. Fixing apparatus for fixing toner images on cylindrical objects partially filled with a liquid, the fixing apparatus comprising:

a hot plate; and a moving surface situated beneath and spaced from the hot plate by a distance such that an object situated between the hot plate and the moving surface contacts both the hot plate and the moving surface.

17. A method for printing images on generally cylindrical objects, comprising:

conveying said generally cylindrical objects to an image bearing surface in timed relation with images on the image bearing surface;

supporting said generally cylindrical objects in rolling contact with said image bearing surface with a support which is generally parallel to the image bearing surface and with which the cylindrical object are also in rolling contacts and transferring said images from said image bearing surface to surfaces of said cylindrical objects when in contact therewith.

18. A method according to claim 17 wherein the support is a generally flexible support.

19. A method according to claim 17 wherein the support is a generally fixed support.

20. A method according to claim 17 wherein the generally cylindrical object are circularly generally cylindrical object.

21. A method according to claim 17 wherein the generally cylindrical objects are generally elliptically cylindrical object.

22. A method according to claim 17 and including heating said generally cylindrical objects before printing.

23. A method according to claim 17 and including heating at least a portion of an outer surface of said generally cylindrical objects after printing.

24. A method according to claim 17 and including pre-coating said generally cylindrical objects with a polyvinylpyridine homopolymer prior to printing thereon.

25. A method according to claim 17 and including pre-coating said generally cylindrical objects with a polyvinylpyridine copolymer with styrene prior to printing thereon.

26. A method according to claim 17 wherein the images are toner images.

27. A method of printing toner images on a metal surface including:

coating the metal surface with a polyvinylpyridine homopolymer; and printing the toner image on the coating.

28. A method according to claim 27, wherein the toner image is a liquid toner image comprising pigmented toner particles and carrier liquid.

29. A method or printing toner images on a metal surface including:

coating the metal surface with a polyvinylpyridine copolymer with styrenei and printing the toner image on the coating.

* * * * *

UNITED STATES PATENT AND TRADEMARK OFFICE

CERTIFICATE OF CORRECTION

PATENT NO. : 5,893,016

DATED : April 6, 1999

INVENTOR(S) : B. LANDA et al.

It is certified that error appears in the above-identified patent and that said Letters Patent is hereby corrected as shown below:

On the cover of the printed patent, at item [75], Inventors, change "Ishaian" to —Ishaiau—.

On the cover of the printed patent, at item [56], References Cited, the following was omitted and should be inserted:
—Patent Abstract of Japan Vol. 13, No. 498 (M-890) 9 November 1989—

At column 14, line 56 (claim 5, line 2) of the printed patent, before "cylindrical" insert —generally—.

At column 15, line 5 (claim 8, line 5) of the printed patent, after "by" delete "at".

At column 15, line 9 (claim 9, line 2) of the printed patent, change "object" to —objects— (both occurrences).

At column 15, line 15 (claim 12, line 1) of the printed patent, after "apparatus" insert ---according to---.

At column 15, line 16 (claim 12, line 2) of the printed patent, change "object" to —objects— (both occurrences).

At column 15, line 17 (claim 13, line 1) of the printed patent, delete "accordingly claim 1".

At column 15, line 43 (claim 17, line 10) of the printed patent,

UNITED STATES PATENT AND TRADEMARK OFFICE

CERTIFICATE OF CORRECTION

PATENT NO. :5,893,016

DATED :April 6, 1999

INVENTOR(S) :B. LANDA et al.

It is certified that error appears in the above-identified patent and that said Letters Patent is hereby corrected as shown below:

change "contacts" to ---contact;---.

At column 16, line 9 (claim 20, line 2) of the printed patent, change "object" to ---objects--- (both occurrences).

At column 16, line 12 (claim 21, line 3) of the printed patent, change "object" to ---objects---.

At column 16, line 37 (claim 29, line 1) of the printed patent, change "or" to ---of---.

At column 16, line 40 (claim 29, line 4) of the printed patent, change "styrenei" to ---styrene;---.

Signed and Sealed this

Fourth Day of July, 2000

*Attest:*

Q. TODD DICKINSON

*Attesting Officer*

*Director of Patents and Trademarks*